US006039281A

United States Patent [19]

Badiali et al.

[11] Patent Number: 6,039,281

[45] Date of Patent: Mar. 21, 2000

[54] METHOD FOR JOINING TEXTILE YARNS FOR RESTORING THEIR CONTINUITY IN A WINDING UNIT

[75] Inventors: Roberto Badiali, Pordenone; Luciano Bertoli, Fiume Veneto; Giorgio Colomberotto, Sacile, all of Italy

[73] Assignee: Savio Macchine Tessili SpA, Pordenone, Italy

[21] Appl. No.: 08/614,133

[22] Filed: Mar. 12, 1996

[30] Foreign Application Priority Data

Mar. 31, 1995 [IT] Italy ..... MI95A0647

[51] Int. Cl.[7] ..... B65H 69/04; D01H 9/10

[52] U.S. Cl. ..... 242/475.5; 57/22; 57/264

[58] Field of Search ..... 242/35.6 R, 475.1, 242/475.4, 475.5; 57/22, 264

[56] References Cited

U.S. PATENT DOCUMENTS

| | | | |
|---|---|---|---|
| 3,918,651 | 11/1975 | Uchida | 242/35.6 R |
| 4,513,921 | 4/1985 | Imoda et al. | 242/35.6 R X |
| 4,733,829 | 3/1988 | Mima | 242/35.6 R |
| 4,877,194 | 10/1989 | Matsui et al. | 242/35.6 R |
| 4,911,372 | 3/1990 | Uchida et al. | 242/35.6 R |
| 5,127,595 | 7/1992 | Tone | 242/35.6 R |
| 5,149,001 | 9/1992 | Banba et al. | 242/35.6 R X |

FOREIGN PATENT DOCUMENTS

| | | |
|---|---|---|
| 0 134 764 | 3/1985 | European Pat. Off. . |
| 41 24 036 | 1/1992 | Germany . |

*Primary Examiner*—Michael R. Mansen
*Attorney, Agent, or Firm*—Kramer Levin Naftalis & Frankel LLP

[57] ABSTRACT

A method for joining textile yarns to restore their continuity each time this becomes necessary in a winding unit, wherein the method is implemented in a joining device which operates several successive steps, one following another, to achieve a continuous connection. The individual operations involved in the method for joining being independent of each other and being autonomous and flexible in their implementation, each implemented step being subjected to an acceptance check based on predetermined quality standards before proceeding to the next operation in the same joining cycle.

8 Claims, 2 Drawing Sheets

METHOD FOR JOINING TEXTILE YARNS FOR RESTORING THEIR CONTINUITY IN A WINDING UNIT

BACKGROUND OF THE INVENTION

1. Field of the Invention

This invention relates to a method for joining textile yarns for restoring their continuity in a winding unit, in particular a bobbin winding unit, in which the individual joining operations are independent of each other, and of automatic and flexible implementation.

2. Description of the Art

As is well known, a yarn produced in a spinning machine, particularly a ring spinning machine, is normally wound onto a tube and conveyed as a yarn package to a bobbin winding unit. Because of the limitations of a ring spinning machine, the yarn packages contain a relatively small quantity of yarn, of about a few hundred grams at most.

Consequently they are unwound and then rewound into bobbins in which the yarn quantity is very large, consequently for forming the bobbin some tens of packages are required, so that on changing the package the yarn has to be knotted or joined, after which the known rewinding of the yarn from the new package commences. In an automatic bobbin winding unit used for this rewinding, if a particularly thick or thin portion appears, a procedure is undergone by which the thick portion or the like is detected by a yarn clearer provided in the winding station, the yarn then being totally cut through and the yarn defect removed, after which the yarn is knotted or joined and yarn rewinding recommences. The combination of yarn defects and package changing results in very frequent yarn joining. In particular, if a bobbin carrying a fixed quantity of wound yarn has a large number of knotted joints, these joints must be perfectly made otherwise they can be intercepted by the eye of a needle or of a heddle in the subsequent operation of a knitting machine or loom, resulting in yarn breakage and the requirement for frequent yarn joining, with a low final product production rate. Relatively frequent yarn joining during rewinding additionally implies a low bobbin formation efficiency because of the continual repeating of the knotting cycle. Consequently the knotting cycle has to be as short as possible while at the same time producing acceptable quality. It should be noted that if yarn joints are not of acceptable quality, the bobbins produced are unacceptable in that it is almost impossible for an operator to distinguish these with the eye in a knitting or weaving operation, resulting in a disconcerting deterioration in the subsequent stages of the article production process. To overcome these and other drawbacks, the applicant has experimented with a textile yarn joining method for restoring continuity each time the yarn breaks, or is cut by the yarn clearer, or when the package is empty, said method having proved perfectly reliable in effecting rapid and accurate joining cycles. Hence the present invention not only substantially increases wound yarn bobbin production but also ensures correct yarn behaviour during automatic bobbin winding.

SUMMARY OF THE INVENTION

In accordance therewith the present invention provides a method for joining textile yarns by a joining device which operates by inserting the yarns one to the side of the other, cutting them to form a knot of determined length, tapering the ends, and superimposing them to compact them with fluids and known means in order to achieve a continuity connection by twisting the fibres together, in said method the individual operational steps involved in the joining being independent of each other, and being autonomous and flexible in their implementation. Furthermore, according to the method of the present invention, each individual operation in the joining cycle is subjected to an acceptance check based on predetermined quality standards before proceeding to the next operation in the cycle.

Again according to the method of the present invention, the individual operations of the joining cycle are grouped operationally into at least two consecutive operations before being subjected to an overall acceptance check to enable the next operation of the same joining cycle to proceed.

According to one embodiment of the method of the present invention each individual joining operation is programmed to occur at least two consecutive times before undergoing the acceptance check based on the predetermined quality standards.

BRIEF DESCRIPTION OF DRAWINGS

A preferred embodiment of the invention is described hereinafter by way of non-limiting example with the aid of the accompanying drawings, in which.

DETAILED DESCRIPTION

Figure 1:
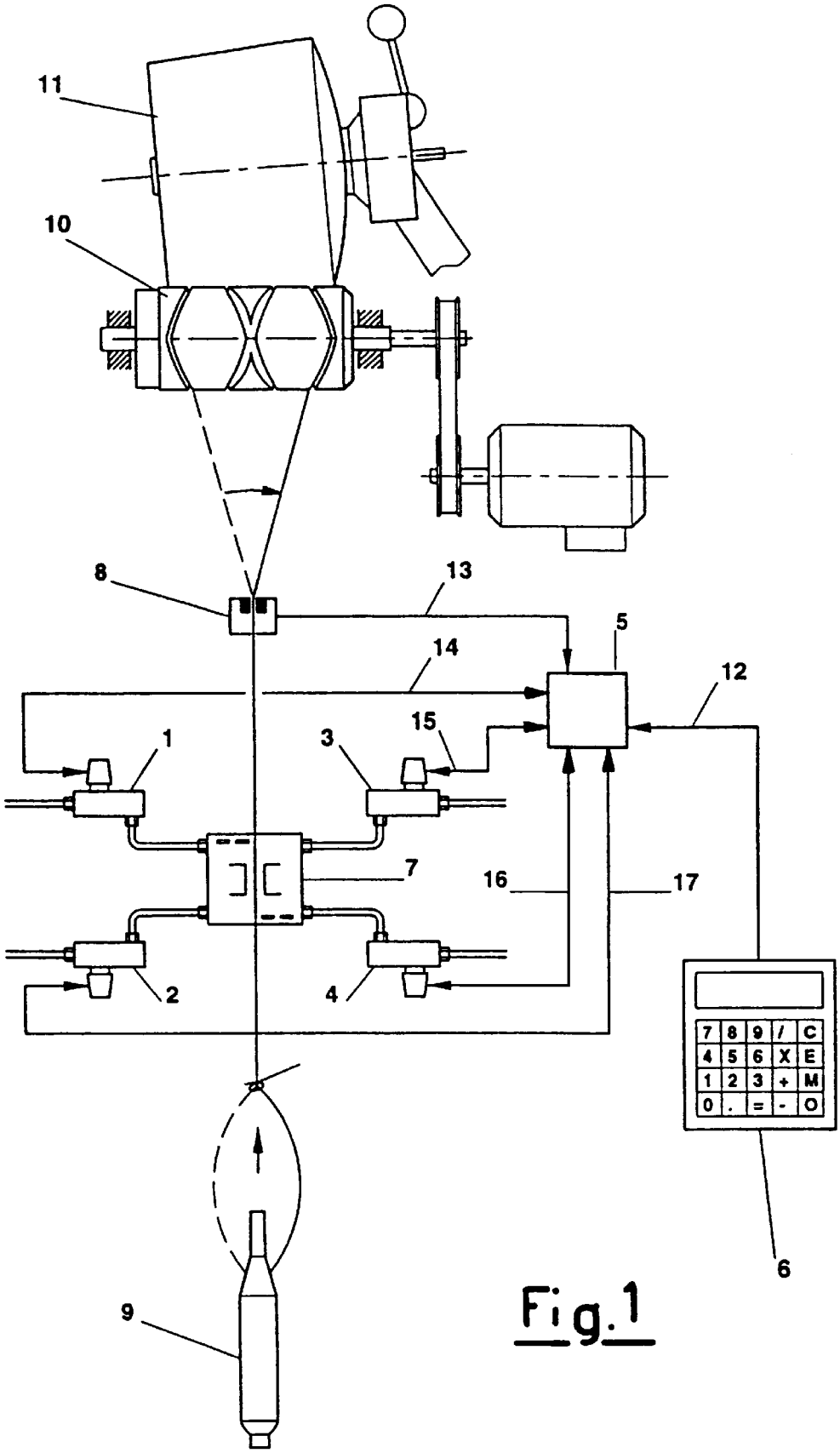
FIG. 1 is a schematic overall view of the apparatus which implements the method of the present invention, said view showing an example of the general structure of an individual bobbin winding station in which the actuators of the individual yarn joining operations are connected to the joining device and to the control unit, which is advantageously connected to a control keyboard for inserting joining data defined by the winding process.

In the figures, equal elements or elements of equal or equivalent function carry the same reference characters for simplicity. Those devices and mechanisms operating in mutual cooperation with the apparatus implementing the method of the present invention are not shown, neither is their operation described in connection with the invention.

In an automatic bobbin winding unit shown schematically in FIG. 1, the yarn extracted from a spinning package 9 is drawn upwards by the drive roller 10 to wind as crossed turns on the surface of the bobbin 11 under formation. The yarn leaving the package 9 moves rapidly upwards passing through a series of known devices and in particular an electronic yarn clearer 8, which acts as a device for automatically monitoring yarn presence and actively controlling the clearing function of an electronic yarn cleaner 8 in the individual bobbin winding station of FIG. 1. The electronic clearer 8 can be of conventional construction and can contain an electrical or capacitive sensor-transducer as the yarn feeling or exploration device. During the winding operation the electronic clearer 8 detects the presence of moving yarn and continuously generates electrical pulses which are transmitted via the cable 13 to the control unit 5. The control unit 5 utilizes said pulses to ascertain the presence of regularly winding yarn by comparison with reference values fed from the keyboard 6 via the cable 12.

Figure 2:
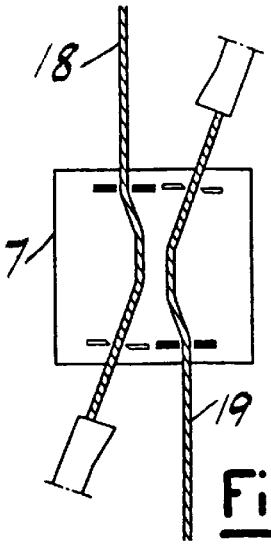
FIGS. 2 and 3 are schematic views of the operating steps following the initial insertion of the yarn ends to be joined together and their cutting and gripping.
Figure 3:
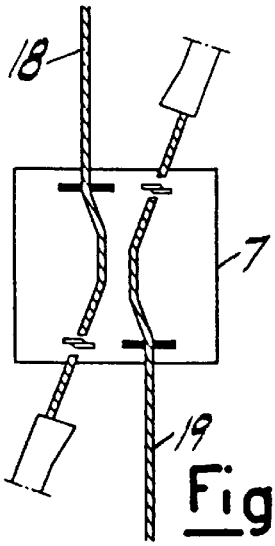

The control unit 5 is based on a miniprocessor able to memorize the operator's instructions and transform said instructions into a program for execution by its computing and processing centre to provide the numerical and graphical results required during the entire winding process. Said numerical and graphical results are then stored in the memory of said control unit 5, which specifically controls the joining device 7 implementing the method of the present invention. Each time the electrical signals originating from the electronic yarn clearer 8 and entering the control unit 5 indicate an interruption in the continuity of the yarn, which has either broken accidentally, or been cut by the clearer or has reached the end of the package, the control unit 5 generates output electrical signals which actuate and control the operating steps connected with the joining device for restoring continuity to the yarn. When yarn interruption is detected the drive roller 10 immediately stops and the operations preceding the actual knotting cycle commence. The control unit 5 generates an electrical output signal which via the cable 14 operates the solenoid valve 1 for cutting and gripping a first yarn end 18 and a second yarn end 19 in known manner after said ends have been initially inserted, as shown schematically in FIGS. 2 and 3.

Known sensor means then effect the acceptance check on said cutting and gripping, the result of this check being communicated in the form of an electrical signal via the cable 14 to the control unit 5 which, on accepting the result on the basis of predetermined quality standards, allows the next operation in the joining cycle to be performed.

If the check does not give an acceptable result on the basis of the predetermined quality standards, the control unit 5 reactivates the solenoid valve 1 in the aforesaid manner and rechecks the result for acceptance.

Figure 4:
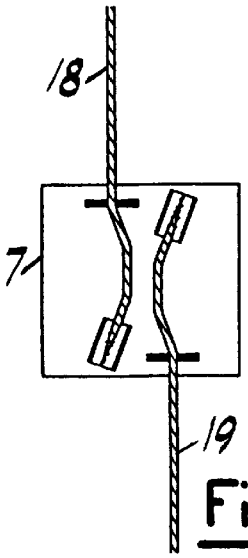
FIGS. 4 and 5 are schematic views of the operations of preparing the ends and superimposing the tapered ends.

This operation can be repeated one or more times on the basis of the program memorized in the control unit 5 before interrupting the knotting cycle. When the check gives an acceptable result the control unit 5 generates an output electrical signal which via the cable 17 actuates the next operation by means of the solenoid valve 2, which operates with known elements in preparing the first and second yarn ends 18, 19 as schematically represented in FIG. 4. When known sensor means verify that the preparation of the yarn ends 18, 19 is acceptably correct, the control unit 5 generates an output electrical signal which, via the cable 15, activates the solenoid valve 3 which, using known means, operates to superimpose the tapered ends.

Figure 5:
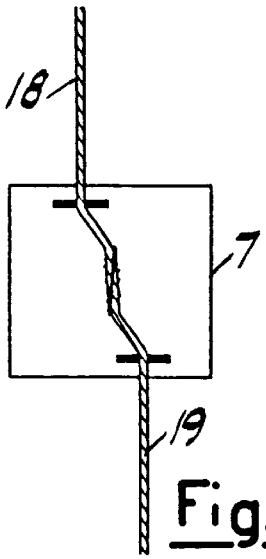
Figure 6:
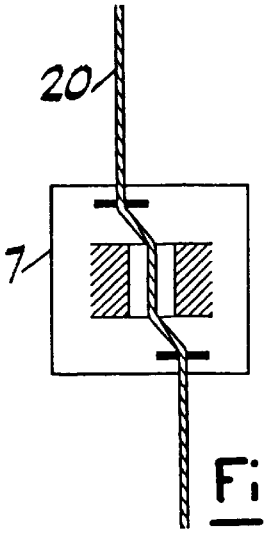
FIGS. 6 and 7 are schematic views of the actual joining operation and the extraction of the now connected and perfectly continuous yarn.

This superimposing is shown schematically in FIG. 5. When this superimposing has passed the acceptability check, the control unit 5 generates an output electrical signal which, via the cable 16, activates the solenoid valve 4 which, by known means and using known elements, operates to effect the actual joining step to achieve a perfect yarn continuity 20 as represented schematically in FIG. 6.

Figure 7:
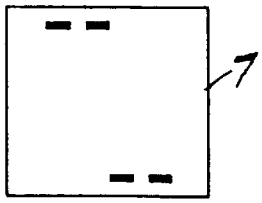

When the yarn joint has been acceptably checked as perfectly continuous in accordance with the predetermined quality standards memorized in the control unit 5, the said control unit 5 generates an output signal which activates the joining device 7 to enable the now connected and perfectly continuous yarn 20 to be extracted (see FIG. 7).

If any of the said operating steps fails its acceptability check based on the predetermined quality standards, it is repeated at least once under the control of the control unit 5, before proceeding to the next operation in the cycle.

Again, in accordance with a preset memorized program, the individual operations of the joining cycle actuated by the joining device 7 are grouped operationally into at least two consecutive operations before being subjected to an overall acceptance check, enabling the next operation in the joining cycle to be effected. A preferred embodiment has been described together with some modifications. It is however apparent that other embodiments falling within the spirit and scope of the method of the present invention are also possible.

We claim:

1. A method for joining textile yarn in a winding unit to restore continuity, comprising the steps of:

inserting into ajoining device first and second yarn ends, then cutting said first and second yarn ends to a pre-determined length for joining, then tapering each of said first and second yarn ends, and then superimposing said first and second yarn ends for compacting to achieve a continuity connection, said method being characterized in that said inserting step is subjected to an acceptance check on the basis of predetermined quality standards before proceeding to said cutting step.

2. The method for joining textile yarn in a winding unit to restore continuity as claimed in claim 1, further comprising the step of performing an additional acceptance check after at least one of said cutting step and said tapering step and said superimposing step.

3. A method for joining textile yarn in a winding unit to restore continuity, comprising the steps of: inserting into a joining device first and second yarn ends, then cutting said first and second yarn ends to a predetermined length for joining, then tapering each of said first and second yam ends, and then superimposing said first and second yarn ends for compacting to achieve a continuity connection, said method being characterized in that said cutting step is subjected to an acceptance check on the basis of predetermined quality standards before proceeding to said tapering step.

4. The method for joining textile yarn in a winding unit to restore continuity as claimed in claim 3, further comprising the step of performing an additional acceptance check after at least one of said inserting step and said tapering step and said superimposing step.

5. A method for joining textile yarn in a winding unit to restore continuity, comprising the steps of: inserting into a joining device first and second yarn ends, then cutting said first and second yarn ends to a pre-determined length for joining, then tapering each of said first and second yarn ends, and then superimposing said first and second yarn ends for compacting to achieve a continuity connection, said method being characterized in that said tapering step is subjected to an acceptance check on the basis of predetermined quality standards before proceeding to said superimposing step.

6. The method for joining textile yarn in a winding unit to restore continuity as claimed in claim 5, further comprising the step of performing an additional acceptance check after at least one of said inserting step and said cutting step and said superimposing step.

7. A method for joining textile yarn in a winding unit to restore continuity, comprising the steps of: inserting into a joining device first and second yarn ends, then cutting said first and second yarn ends to a pre-determined length for joining, then tapering each of said first and second ends, and then superimposing said first and second ends for compacting to achieve a continuity connection, said method being characterized in that said superimposing step is subjected to an acceptance check on the basis of predetermined quality standards.

8. The method for joining textile yarn in a winding unit to restore continuity as claimed in claim 7, further comprising the step of performing an additional acceptance check after at least one of said inserting step and said cutting step and said tapering step.

* * * * *